US006670593B1

(12) United States Patent
Petit-Jean

(10) Patent No.: US 6,670,593 B1
(45) Date of Patent: Dec. 30, 2003

(54) FOOD SEPARATOR

(76) Inventor: Jesus E. Petit-Jean, 31598 Joseph Rd., Hockley, TX (US) 77447-6167

( * ) Notice: Subject to any disclaimer, the term of this patent is extended or adjusted under 35 U.S.C. 154(b) by 74 days.

(21) Appl. No.: 10/065,405

(22) Filed: Oct. 15, 2002

Related U.S. Application Data

(63) Continuation-in-part of application No. 09/609,002, filed on Jun. 28, 2000, now abandoned.

(51) Int. Cl.[7] ..... H05B 6/80
(52) U.S. Cl. ..... 219/732; 219/725; 426/107
(58) Field of Search ..... 219/732, 730, 219/728, 735, 733, 763, 729; 426/107; 99/483, 482, 340, 448, 450

(56) References Cited

U.S. PATENT DOCUMENTS

| | | | | | |
|---|---|---|---|---|---|
| 4,495,860 | A | | 1/1985 | Hitch et al. | 99/340 |
| 4,732,137 | A | | 3/1988 | Parsons | 126/25 |
| 4,748,308 | A | * | 5/1988 | Drew | 219/730 |
| 4,793,324 | A | | 12/1988 | Caferro | 126/369 |
| 5,078,049 | A | | 1/1992 | Glanton | 99/482 |
| 5,117,078 | A | | 5/1992 | Beckett | 219/10.55 |
| 5,242,703 | A | | 9/1993 | Steward | 426/523 |
| 5,320,028 | A | | 6/1994 | Grunberg | 99/340 |
| 5,400,704 | A | * | 3/1995 | Huston | 99/450 |
| 5,404,808 | A | | 4/1995 | Smith | 99/483 |
| 5,585,027 | A | | 12/1996 | Young | 219/730 |
| 5,736,718 | A | * | 4/1998 | Levinson | 219/729 |
| 5,765,471 | A | | 6/1998 | Monard | 99/448 |

* cited by examiner

*Primary Examiner*—Quang T. Van
(74) *Attorney, Agent, or Firm*—Daniel N. Lundeen

(57) ABSTRACT

A pre-assembly of pre-baked corn tortillas are alternatingly stacked with separators to space the tortillas apart to enable water vapor to escape during microwave heating and help keep the tortillas from becoming wet or soggy. The assembly can include a plastic bag for the stack, in a prepackaged form. Also a method for re-heating tortillas by placing the tortilla/separator stack in a microwave heating compartment and allowing water vapor to escape via the separators. The stack can be placed in a microwave-safe serving container with a removable lid to facilitate microwaving and serving the tortillas in a single container.

18 Claims, 24 Drawing Sheets

FOOD SEPARATOR

CROSS REFERENCE TO RELATED APPLICATIONS

This application is a continuation-in-part of my earlier U.S. Serial No. 09/609,002, filed Jun. 28, 2000, abandoned.

BACKGROUND OF INVENTION

This invention relates to a separator apparatus that is to be disposed between items of food in a stack of food items to provide means to enable vapor to move between the stacked food items, and more particularly to a method of re-heating tortillas or flat bread in a microwave oven using the separator apparatus.

A tortilla made from baked corn meal is at traditional food item of Mexico. Individuals of Hispanic descent have brought tortillas into the mainstream of American cuisine. In the United States, tortillas are made from corn meal, ground whole wheat or white flour. In 1998, the purchase of tortillas represented approximately one-half of the total products made from dough purchased in this country.

Traditionally, a tortilla was made by heating corn meal dough on a grill, griddle or frying pan. When this method was used to provide a sufficient supply of fresh, hot tortillas to all diners at a meal, however, the person cooking the tortillas would not be able to participate in the meal with the other diners. Since the activity of providing a steady stream of fresh, hot tortillas to the diners must occur at the same that the diners are eating, the tortilla preparer will be cooking as the other diners eat and has no opportunity to actually participate in the meal as a diner. This problem is essentially resolved by the fact that prepared, packaged tortillas are now easily available throughout the country in all manner of grocery and food stores. To serve a sufficient quantity of tortillas with a meal to fill the appetites of all diners, it is now only necessary to heat the tortillas.

Various inventions have been proposed to warm tortillas. U.S. Pat. No. 5,765,471 to Monrad, U.S. Pat. No. 4,013,869 to Orts and U.S. Pat. No. 4,147,924 to DeWitt all teach electrical devices to heat tortillas. In many instances, however, a microwave oven is the most useful means to use for heating tortillas. In order to heat a large number of tortillas at one time the tortillas are placed one upon the other in a stack. But when tortillas are heated in a stack in a microwave, the water vapor released as moisture during the process results in wet tortillas that tend to stick to one another. Soggy tortillas that are hard to separate are not aesthetically acceptable. It is possible to heat tortillas in a microwave without placing them in a stack, as shown for example by the teaching of the use of microwavable bowl in U.S. Pat. No. 5,756,976 to Akasaka. The Akasaka method has the disadvantage, however, that the tortillas must be individually folded prior to placement in the bowl.

There is still substantial usage of the method of heating tortillas in a microwave in a stack, and a need thus remains to rectify the problem that the water vapor released when tortillas are heated in a stack causes soggy tortillas that stick together. The separator of this invention resolves that problem by enabling water vapor generated during heating to move between the individual tortillas in a stack and thus escape. Excess moisture thus does not collect, as a result of the heating, in a manner that causes soggy or sticky tortillas.

SUMMARY OF INVENTION

In one aspect, this invention relates to a separator, disposed between stacked food items, comprising means to enable vapor to move between the stacked food items.

In a further aspect, this invention relates to stacked food items, between which is disposed a separator that comprises means to enable vapor to move between the stacked food items.

In one embodiment, the invention comprises an assembly of prepared food items and separators alternatingly stacked for microwave re-heating. The assembly includes a plurality of prepared food items arranged in a stack, and separators disposed freely between adjacent food items for releasing water vapor. Each separator between adjacent food items has an essentially planar structure having a top surface and a bottom surface with mullions, channels, ridges or perforations to enable water vapor to move between and away from the adjacent prepared food items. Each separator between adjacent food items has the bottom surface supported on a superior surface of a first one of the adjacent food items, and the upper surface supporting an inferior surface of a second one of the adjacent food items. The stack can also include a lowermost separator below a lowermost one of the said plurality of food items. The food items can be tortillas, preferably corn tortillas. The assembly can also include packaging for the stack, preferably a plastic bag. Alternatively, the assembly can also include a microwave-safe container housing the stack. The container can have thermal insulation, and preferably includes rigid upright walls and a removable lid.

Another aspect of the invention is a method for re-heating a plurality of food items, e.g. flat bread such as tortillas, in a microwave oven, comprising stacking a plurality of the food items alternatingly with the separator placed between adjacent food items, placing the stacked food items in the oven, supplying microwave radiation to heat the food items, and letting water vapor escape from between the food items via the separators.

In one embodiment, the method includes placing the assembly described above in the heating compartment of a microwave oven, introducing microwaves into the heating compartment to heat the prepared food items, and allowing water vapor to escape via the separators. The lowermost separator, when present, is on a microwave support surface, e.g. a plate, tray, or directly on a bottom surface of the heating compartment. Where the stack is packaged, e.g. in a plastic bag, the method preferably includes removing the stack from the packaging before placing it in the microwave heating compartment. If desired, the stack can be placed in a resealable microwave-safe container that is preferably insulated, and the stack/container assembly microwaved; the re-heated tortillas or other food items can thus be conveniently served in the same container used for microwaving, for example by removing and replacing the lid for access to the tortillas, while the insulative effect of the container helps keep the tortillas hot for a longer period of time than if the container were not used.

BRIEF DESCRIPTION OF DRAWINGS

For a more complete understanding of the nature of the present invention, reference should be made to the accompanying drawings taken in connection with the following detailed description.

FIGS. 1, 5, 7, 9 and 15 is each a plan view of the apparatus of the invention in which windows are defined by mullions without a frame, and the mullions are arranged in design to present a geometric pattern.

FIG. 2 is an oblique view of the separator apparatus of FIG. 1 FIGS. 3, 4, 6, 8 and 14 are each a plan view of the apparatus of the invention in which windows are defined by mullions in a frame, and the mullions are arranged in design to present a geometric pattern.

FIGS. 10, 12, 16, 18 and 19 are each a plan view of the apparatus of the invention in which windows are defined by mullions in a frame, and the mullions are arranged in design to portray a known object.

FIGS. 11, 13 and 17 are each a plan view of the apparatus of the invention in which windows are defined by mullions without a frame, and the mullions are arranged in design to portray a known object.

FIG. 20 is a plan view of the apparatus of the invention in which windows are defined by mullions in a frame.

FIG. 21 is a plan view of the apparatus of the invention in which the mullions are arranged in design to spell a word.

FIG. 22 is an exploded view of a stack of pre-baked tortillas alternatingly assembled with the separators of FIG. 1 for heating in a microwave oven according to one embodiment of the invention.

FIG. 23 is a perspective view of the pre-packaged assembly of FIG. 22.

FIG. 24 is a perspective view, partly cut away, of a microwave oven into which the stack of FIGS. 22–23 has been placed for re-heating.

FIG. 25 is a side sectional view of an assembly according to one embodiment of the present invention wherein the stack of FIGS. 22–23 has been placed in a microwave-safe container for re-heating and/or serving.

DETAILED DESCRIPTION

Figure 1:
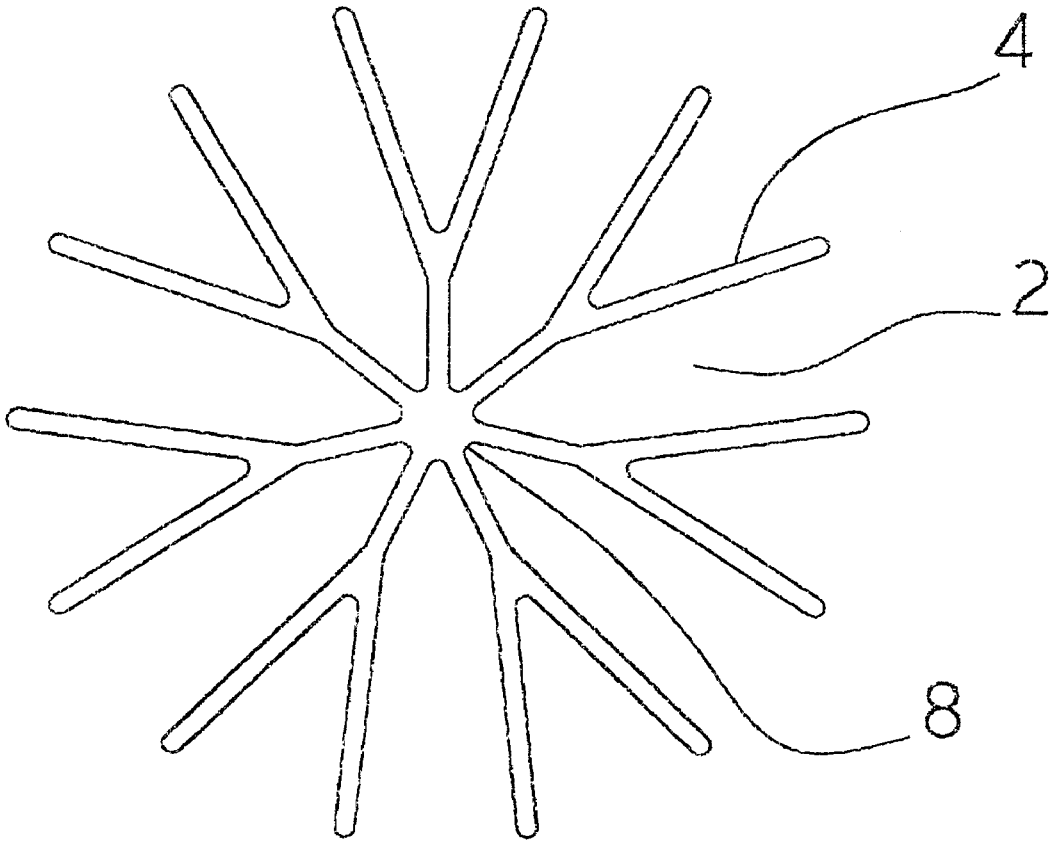
FIGS. 1–25 are not drawn to any particular scale, and are presented for the purpose of describing and illustrating certain embodiments of the present invention.
Figure 2:
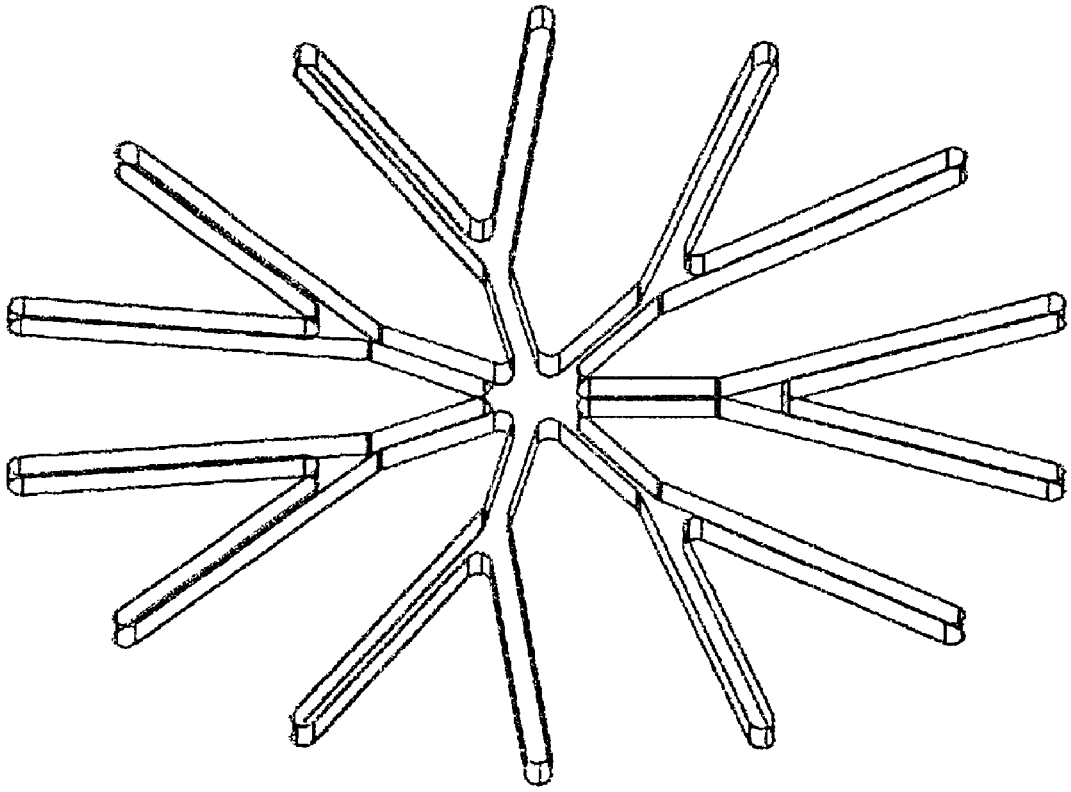
Figure 3:
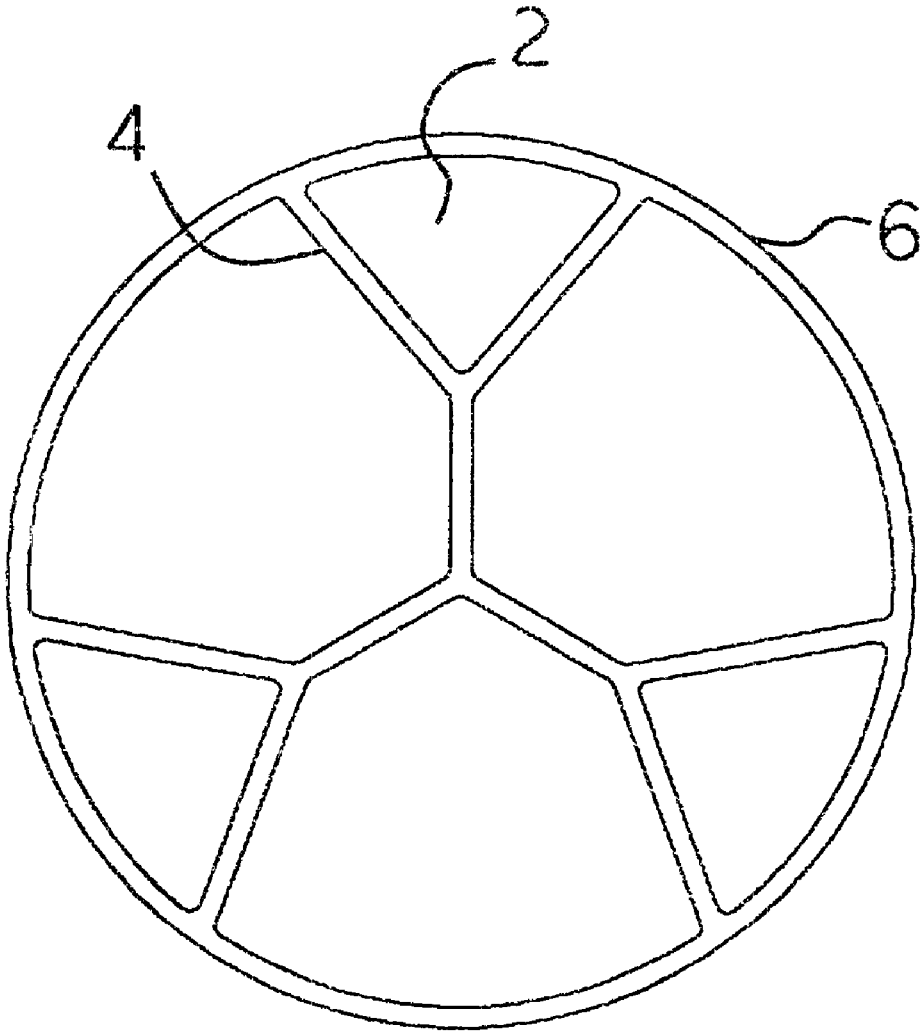
Figure 4:
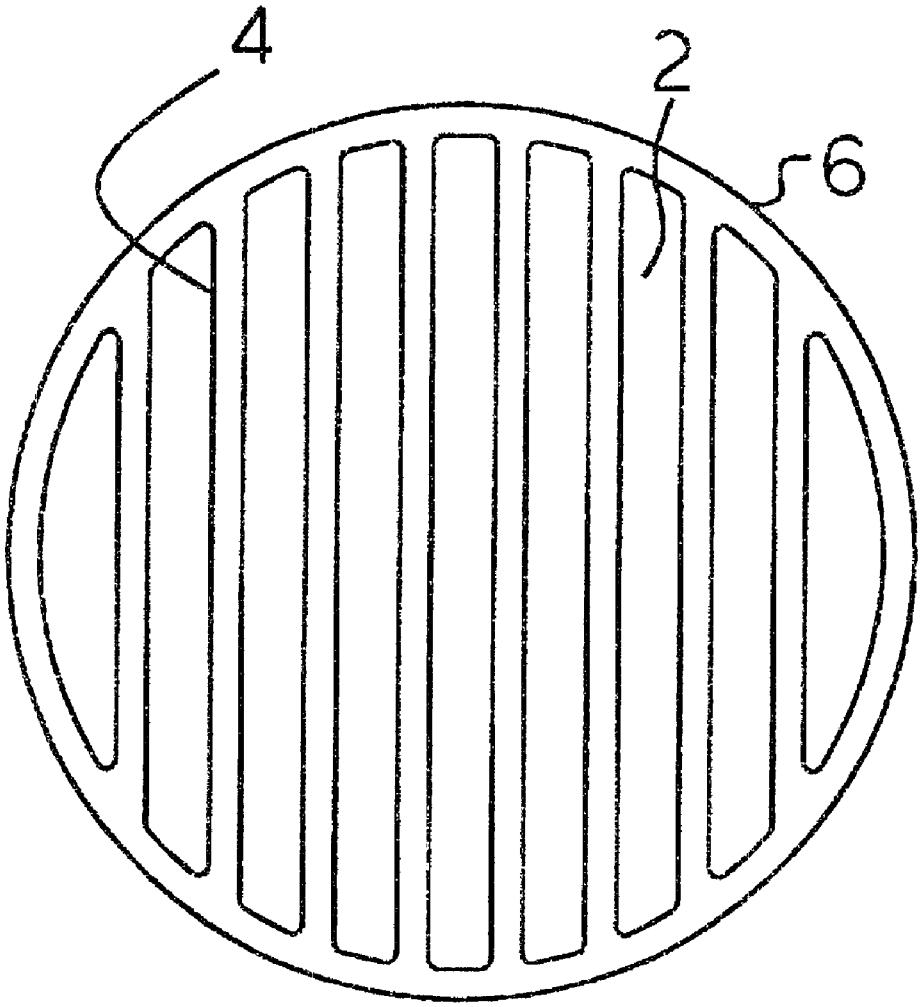
Figure 5:
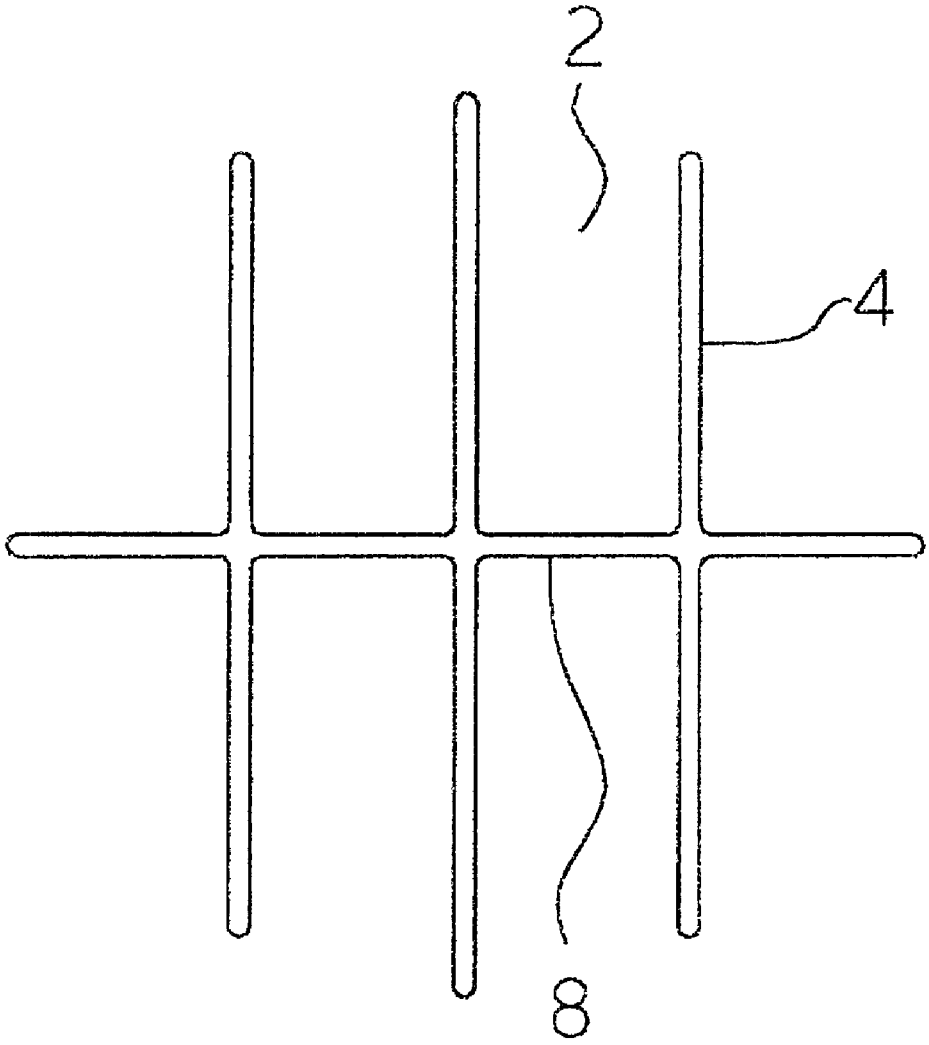
Figure 6:
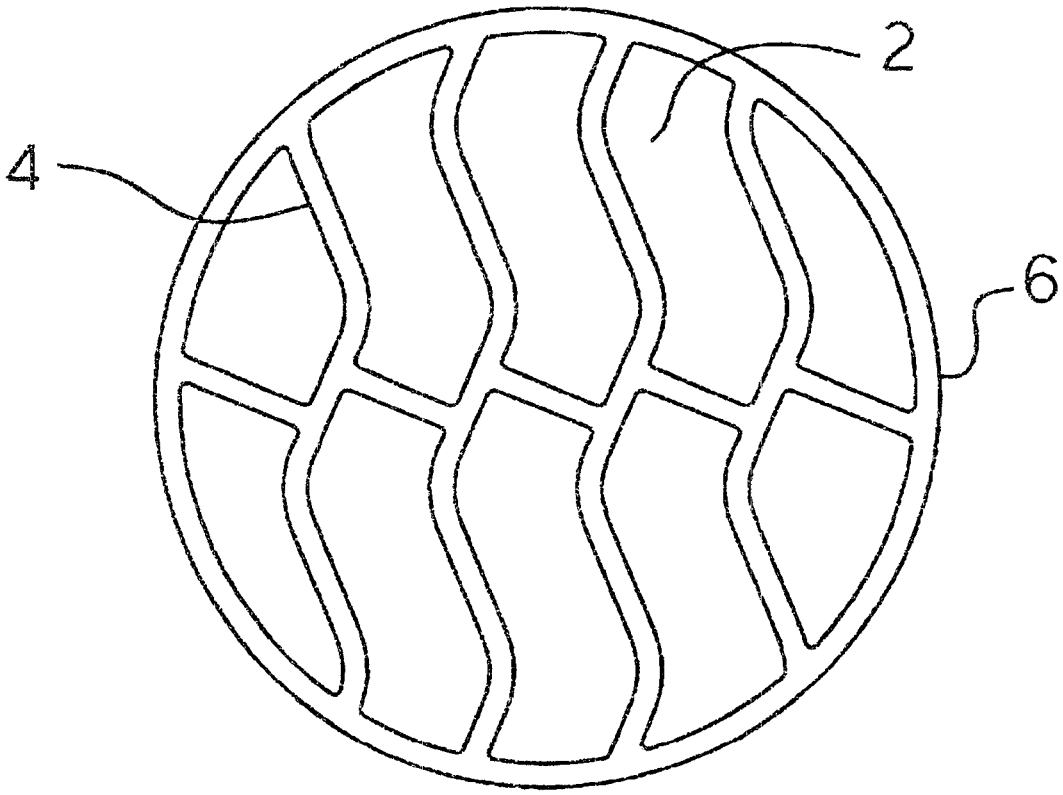
Figure 7:
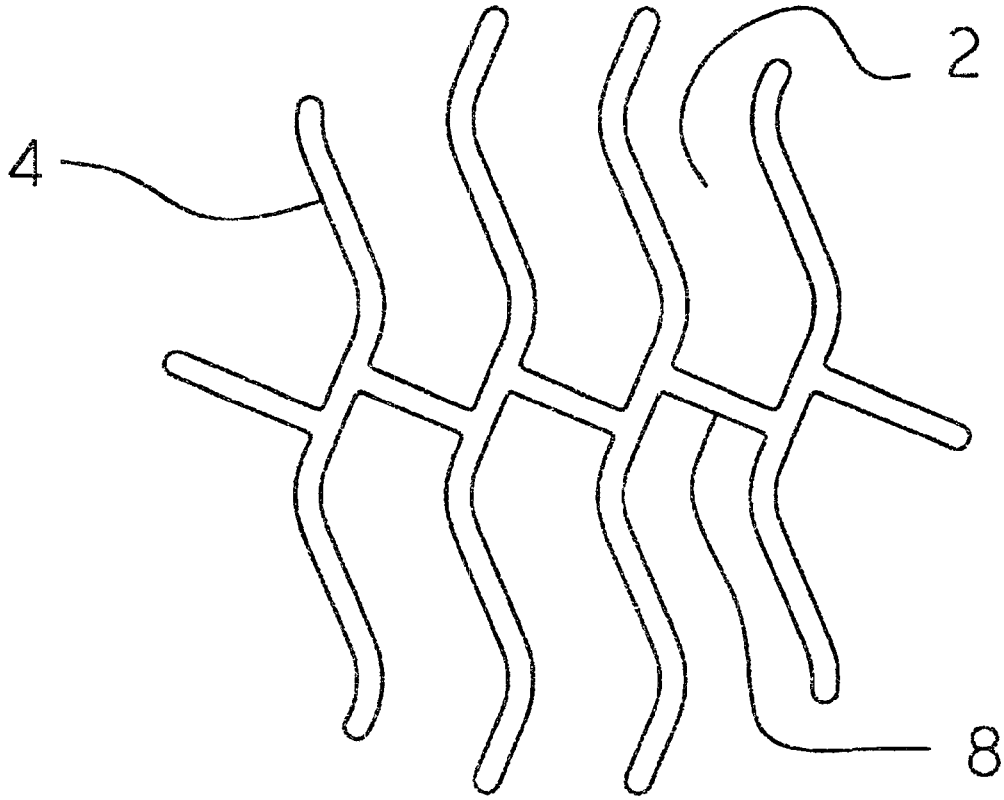
Figure 8:
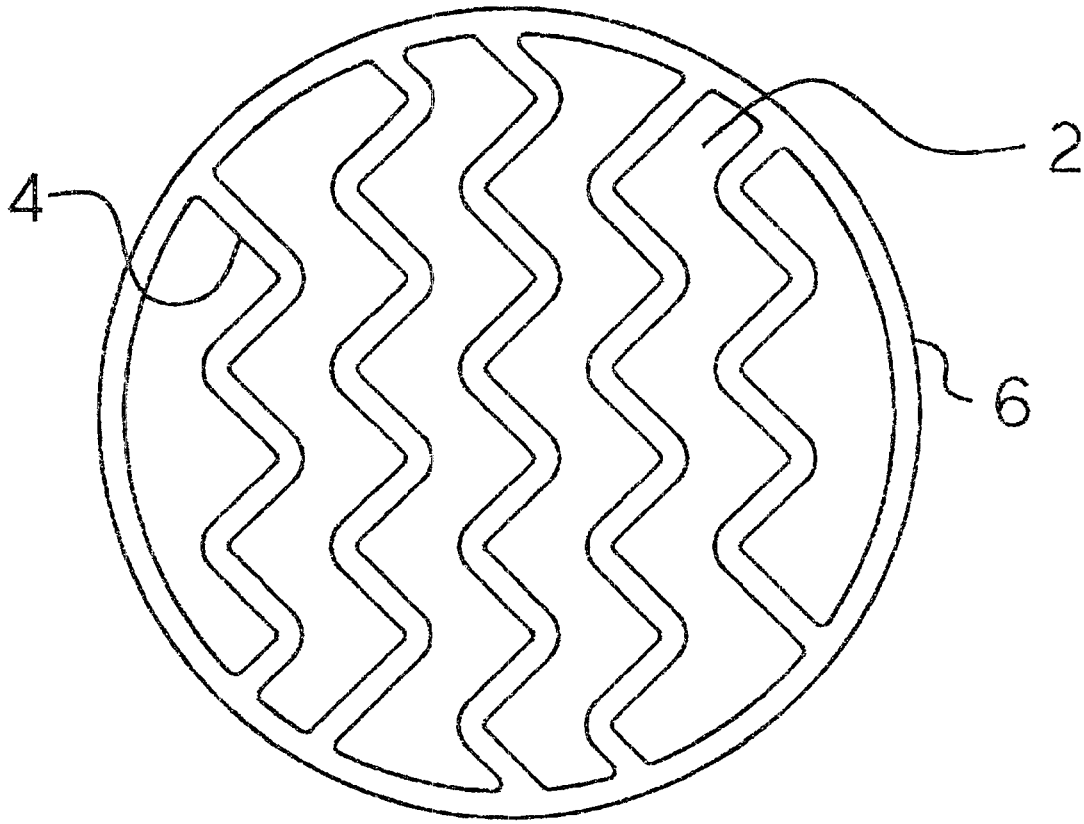
Figure 9:
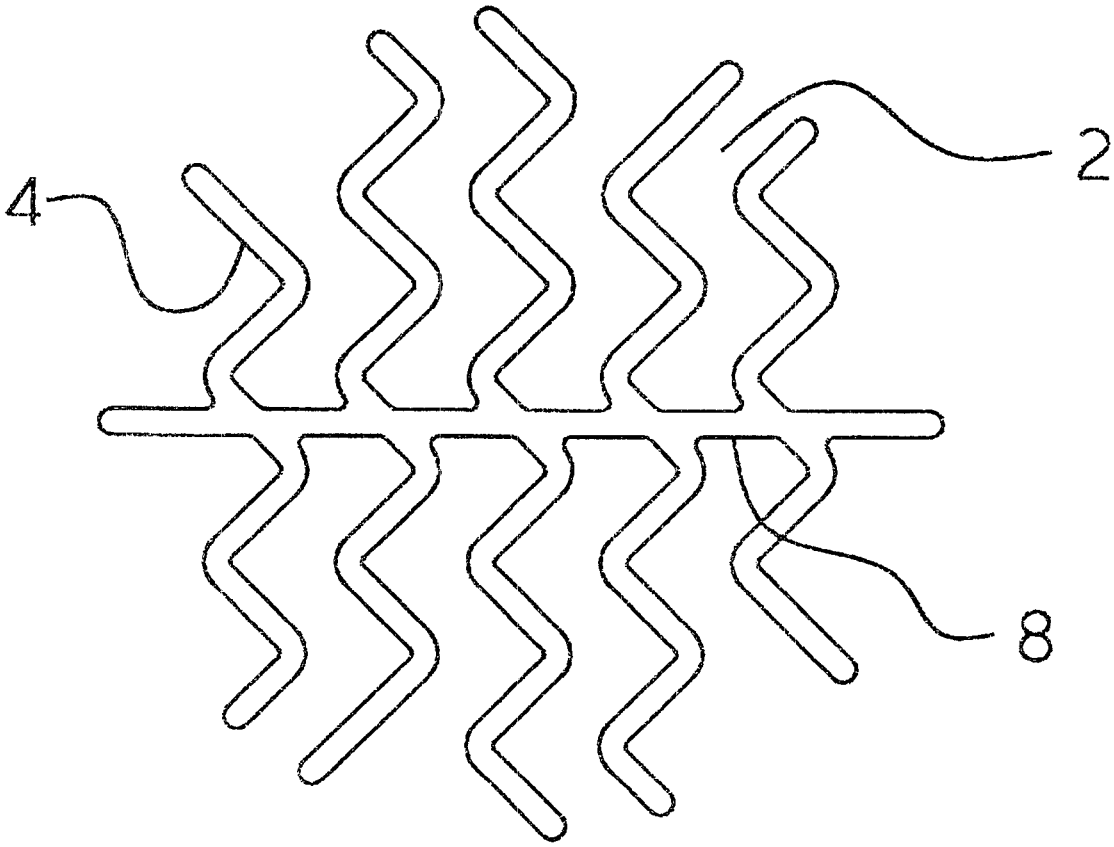
Figure 10:
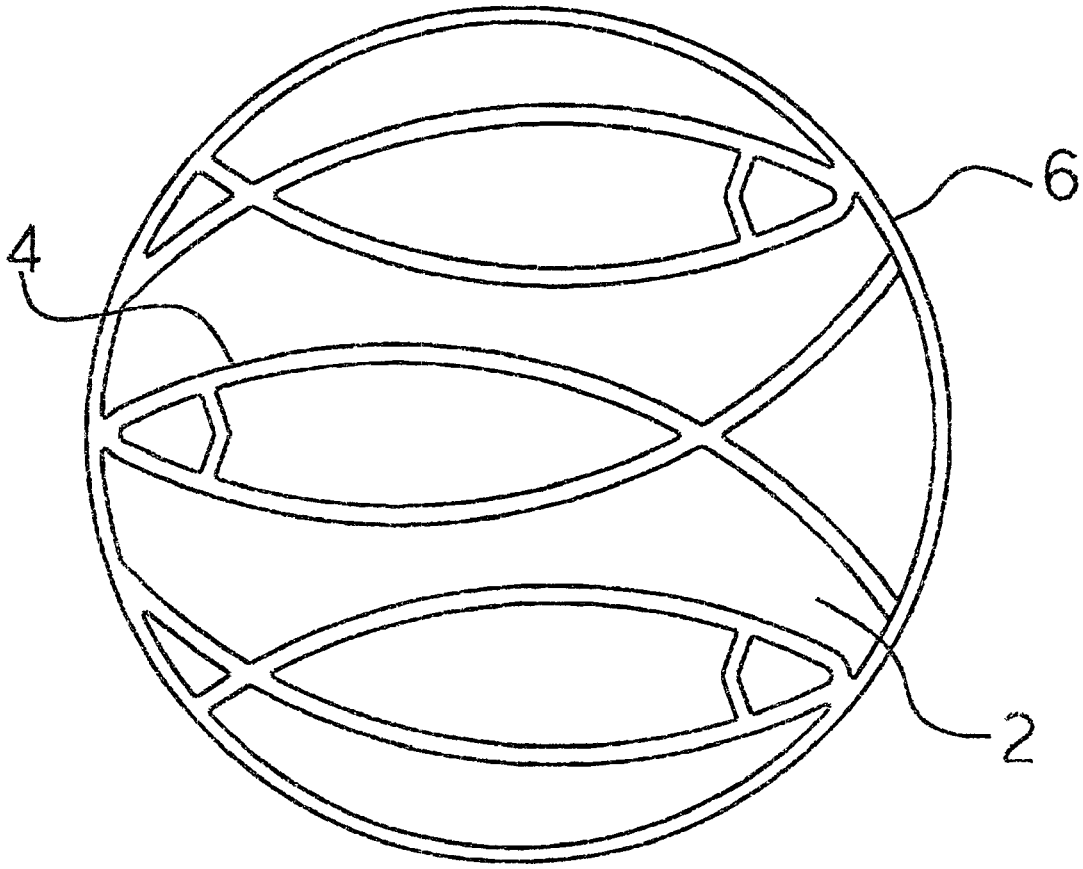
Figure 11:
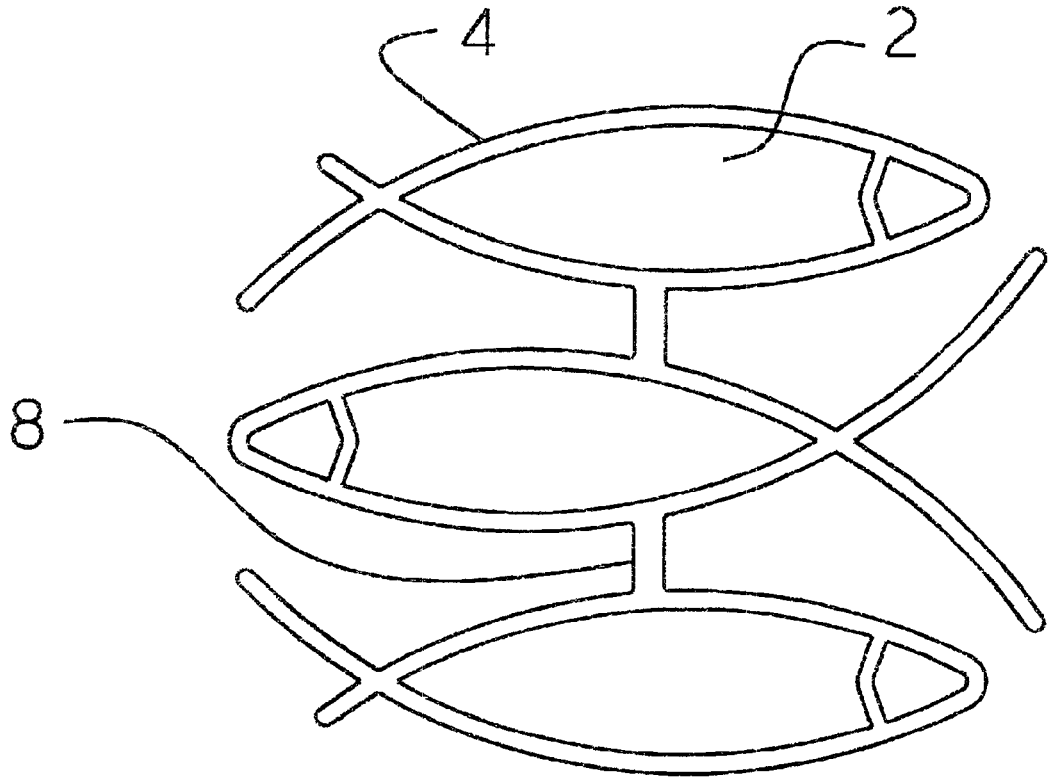
Figure 12:
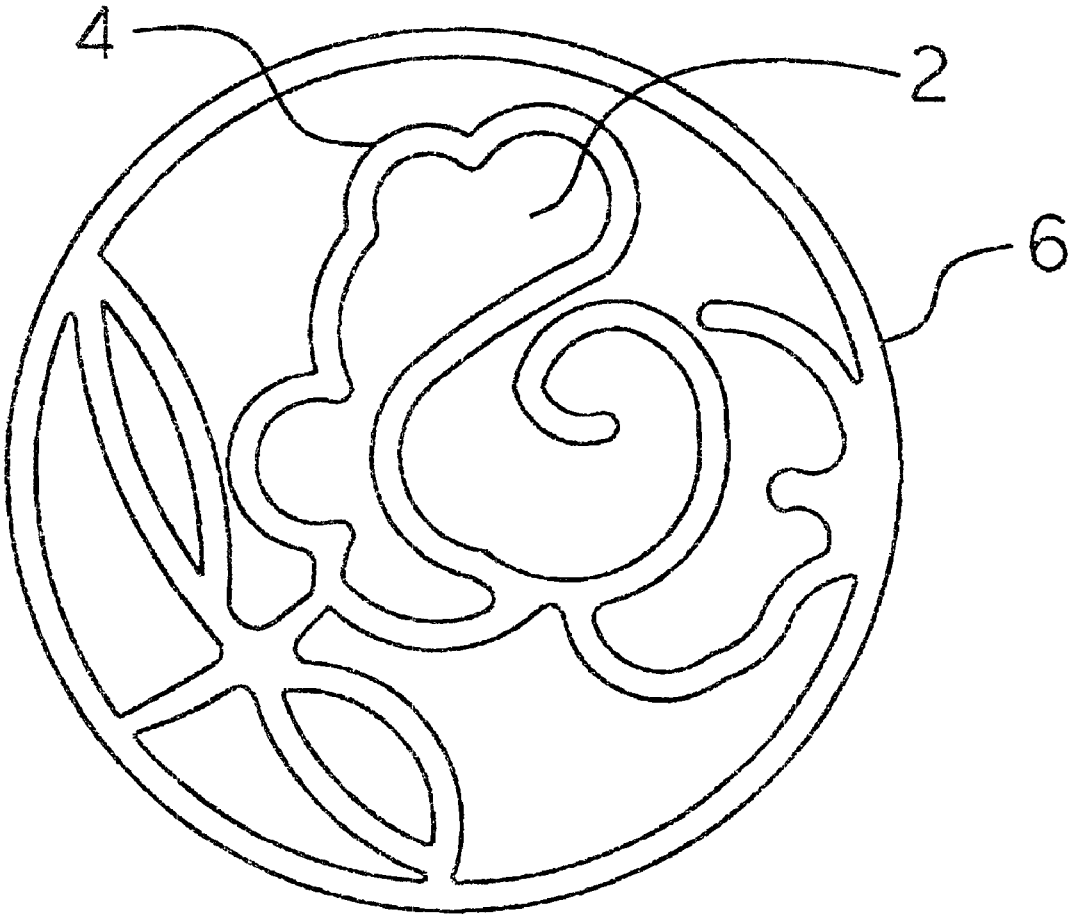
Figure 13:
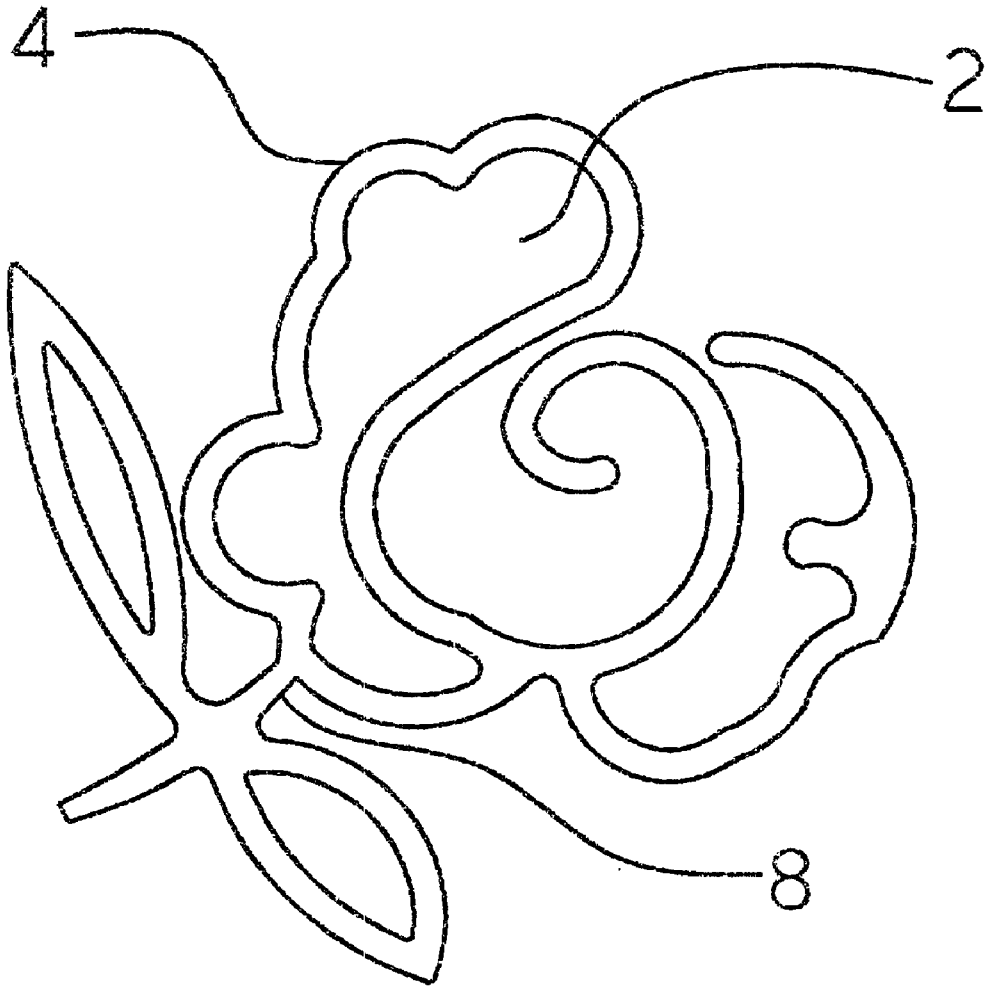
Figure 14:
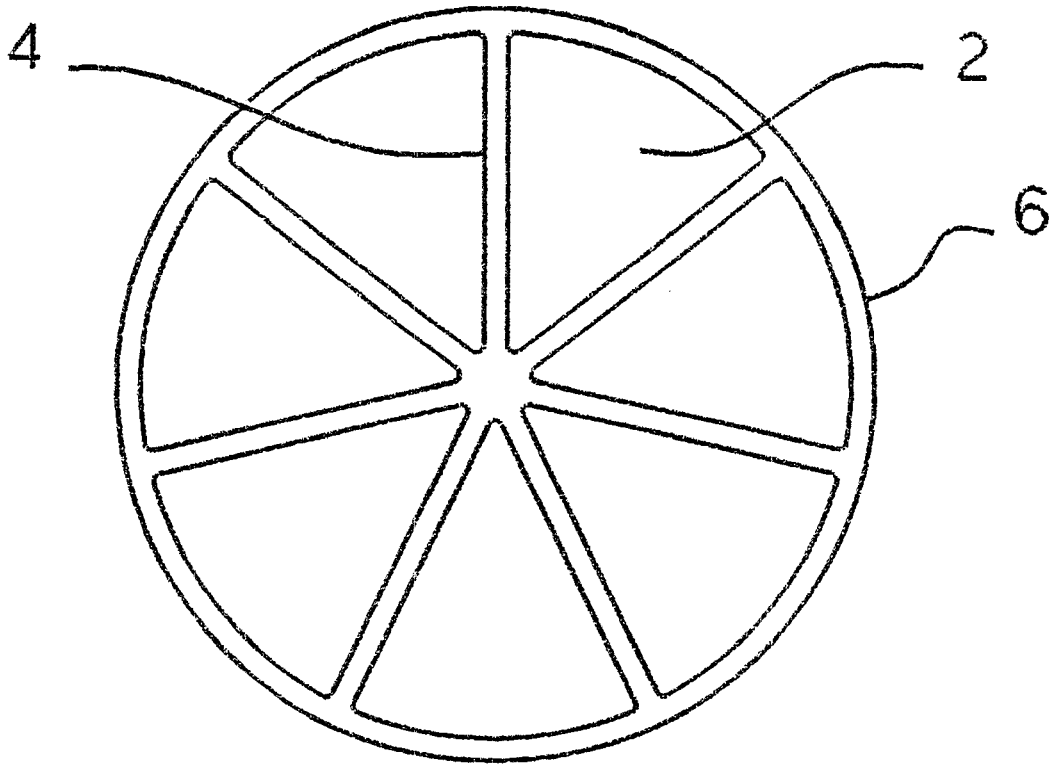
Figure 15:
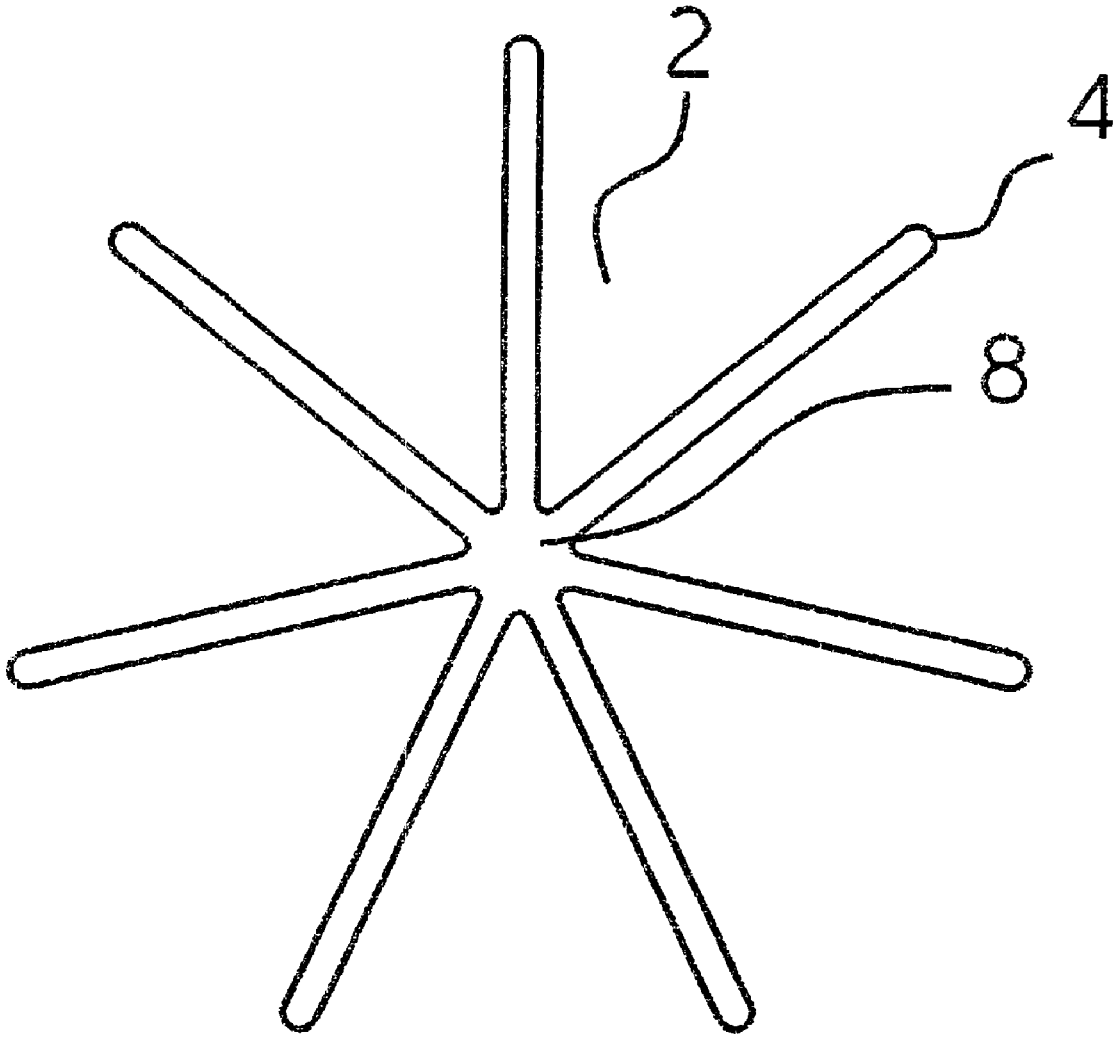
Figure 16:
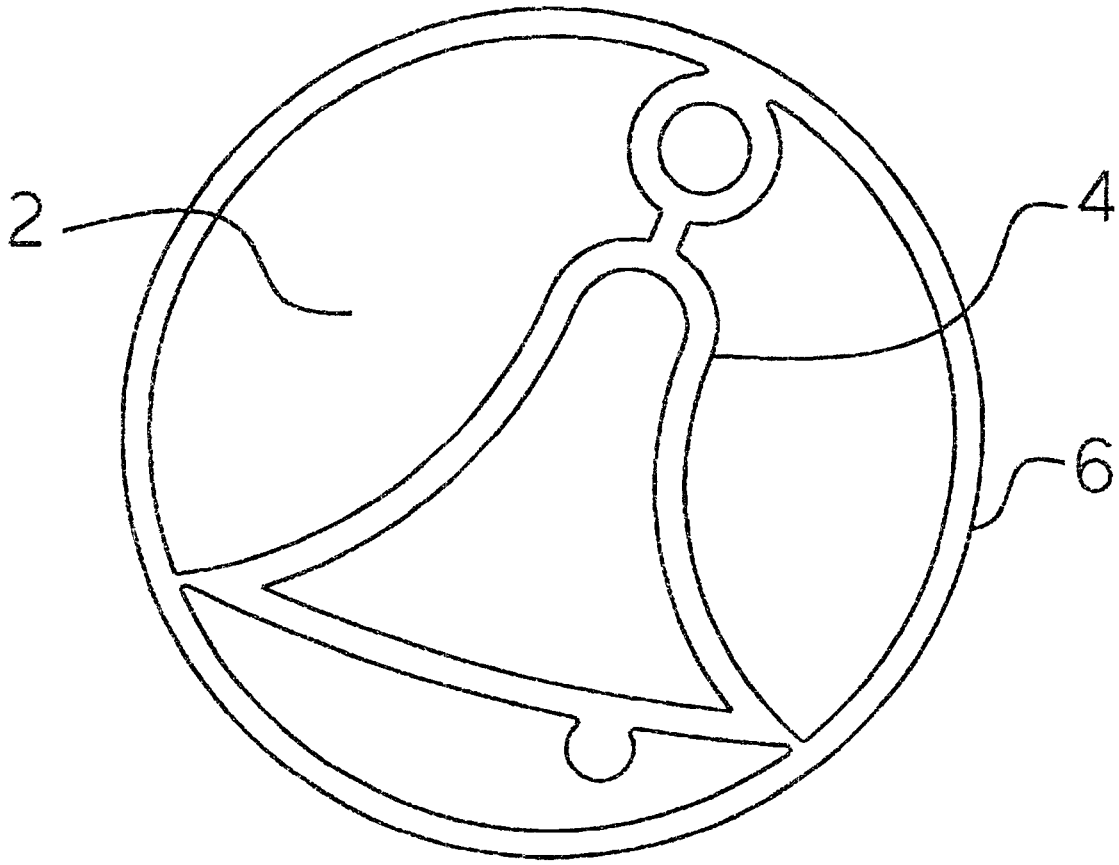
Figure 17:
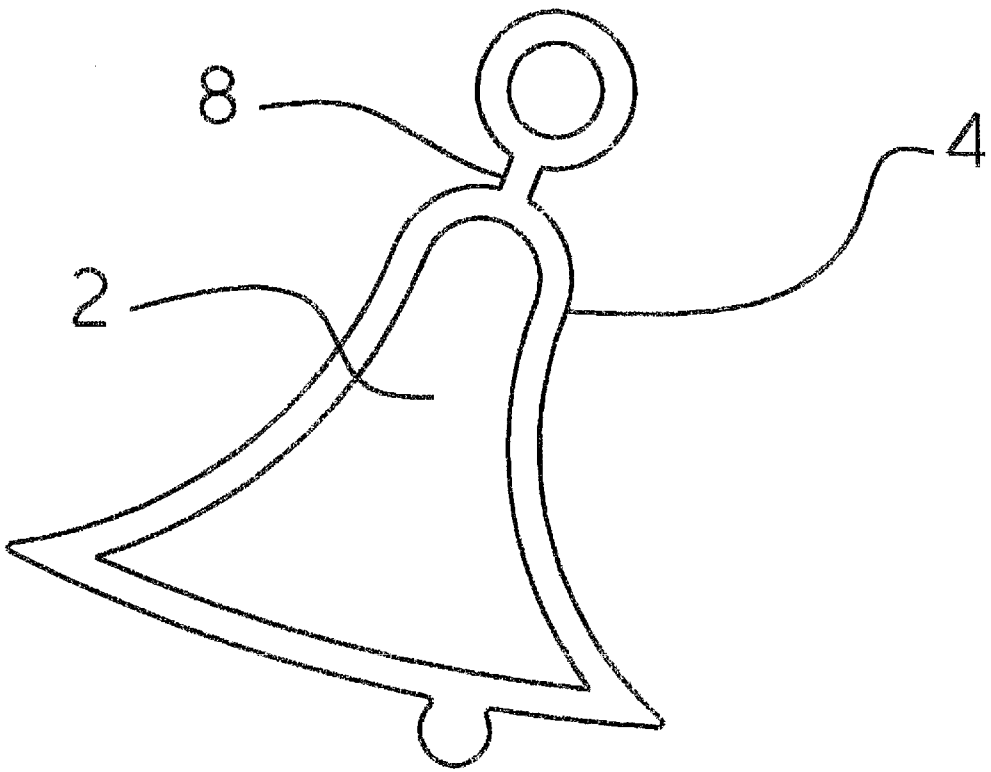
Figure 18:
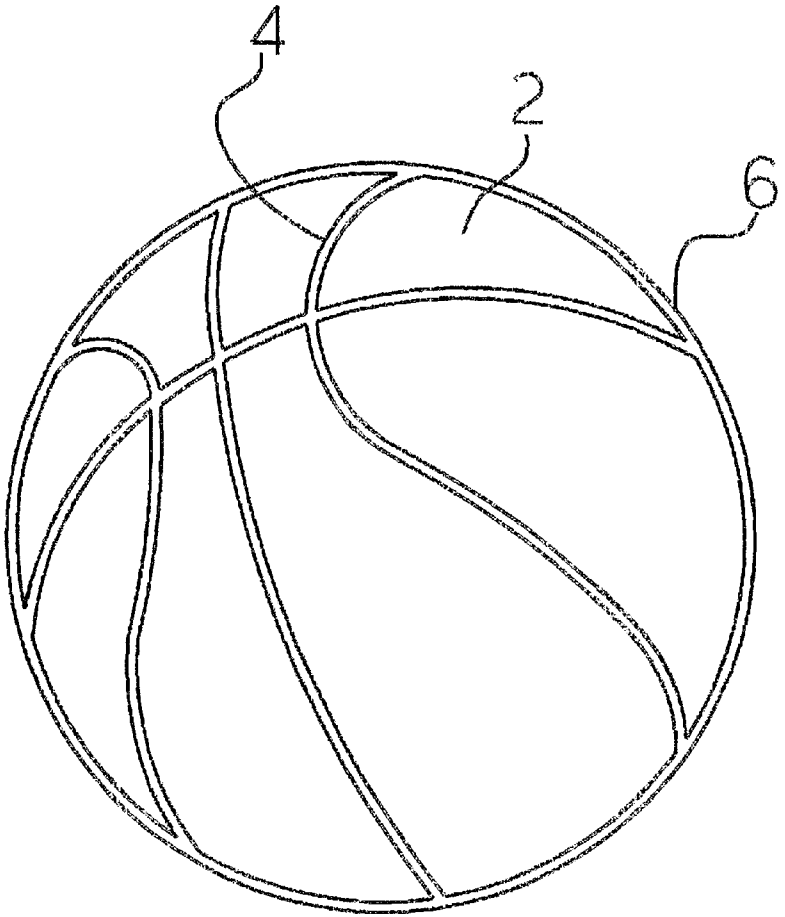
Figure 19:
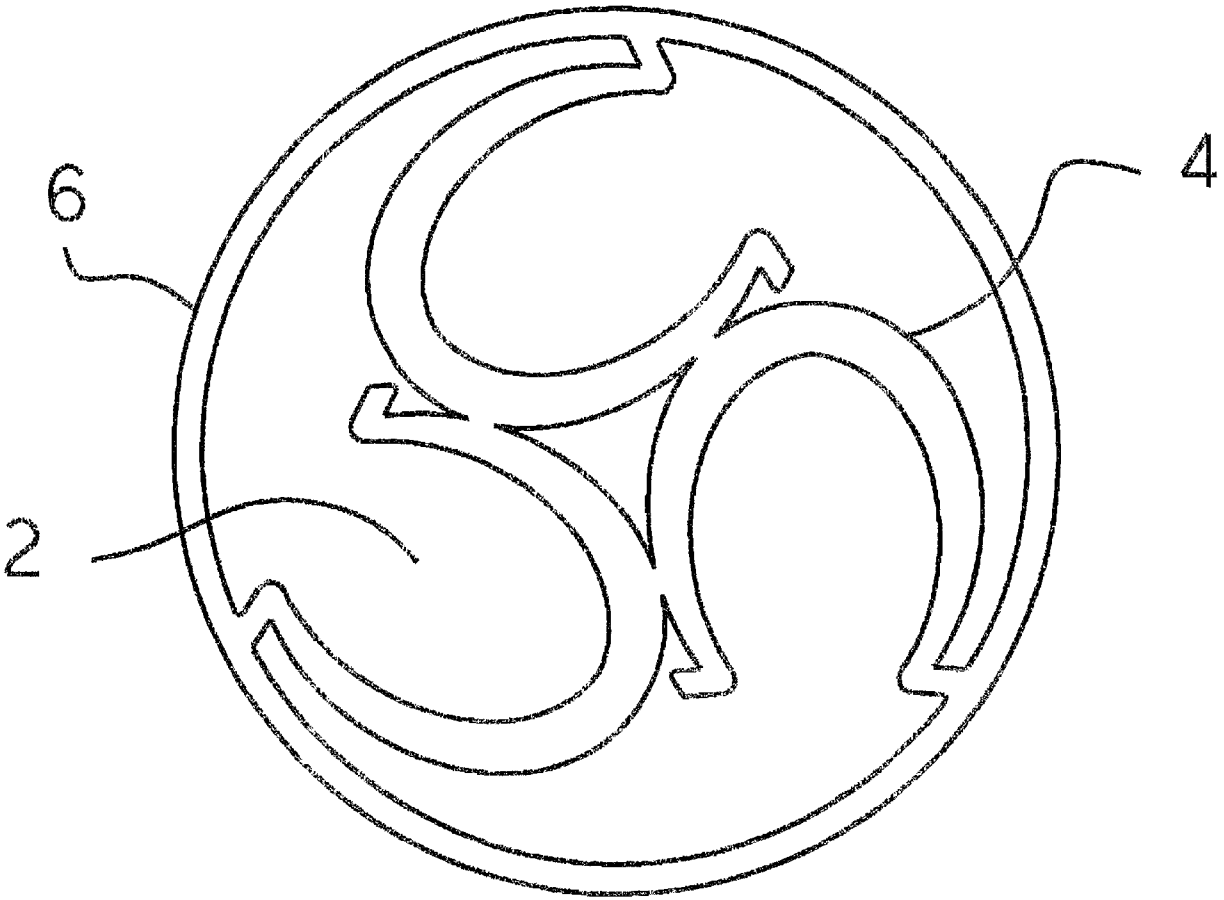
Figure 20:
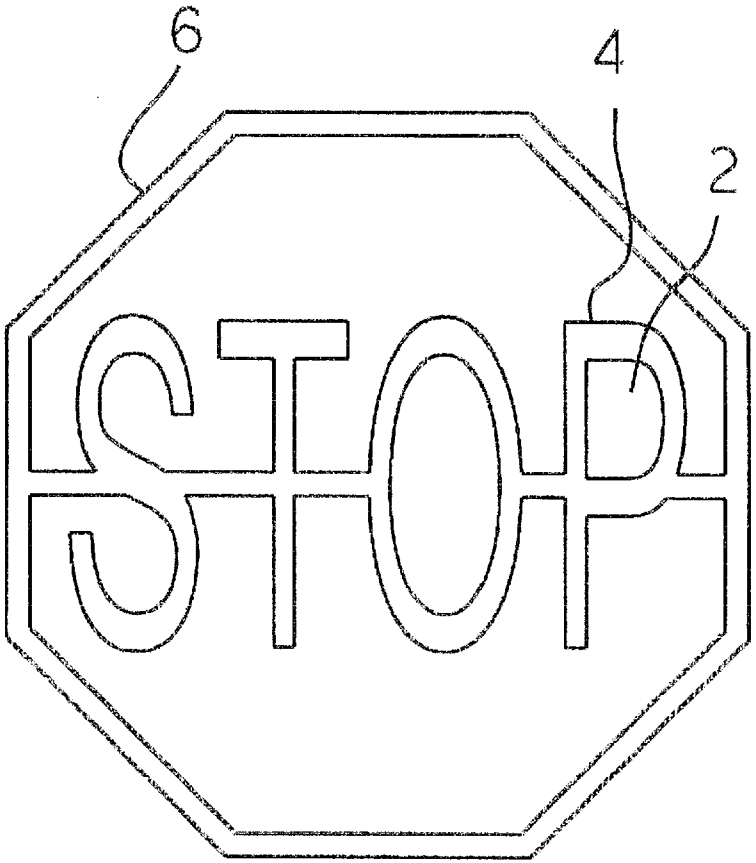
Figure 21:
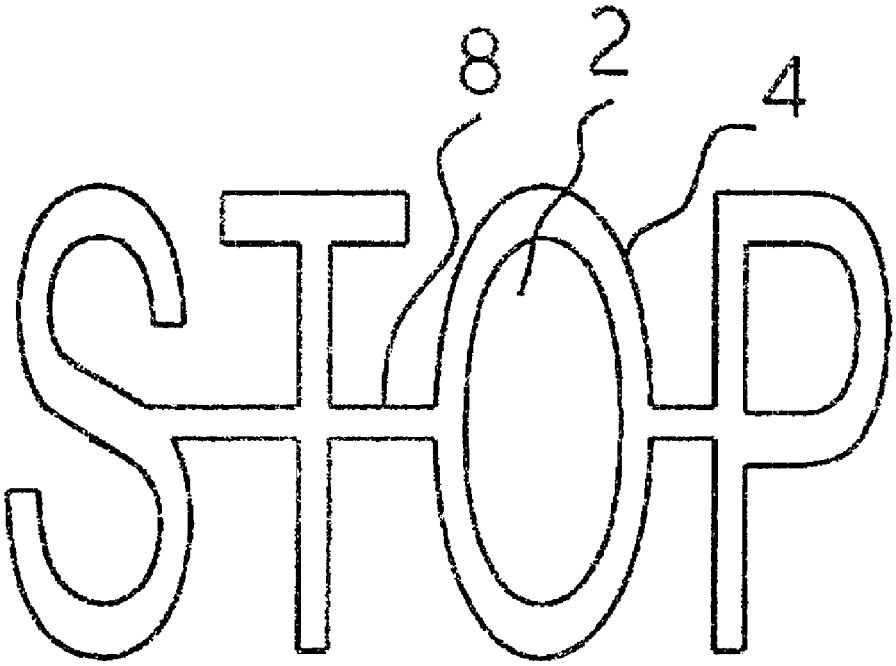

The separator of this invention enables vapor such as water vapor or steam to move between food items. A need to enable vapor to move between stacked food items generally arises when the food items are being heated. The source of the vapor may be liquid, such as water, inherently present in the food items before the heating process occurs, or may be liquid purposely added at the time of heating. The heating may occur in any type of heating or cooking facility such as a stove or oven, but the present invention is most beneficially used in connection with reheating in a microwave oven. To enable vapor to move between the stacked food items, the separator is disposed between the stacked food items.

The term "stack" is used herein, with reference to the food items, in the sense of a group or bundle of food items. The term "stack" often denotes a vertical pile, but it is not required that the separator of this invention be used only in conjunction with food items that are arranged in a vertical orientation with respect to each other. Often that will be the most convenient use since the separator can usually be most easily disposed freely between the food items without other containment means if the separator and food items are arranged in vertical orientation with respect to each other. The term "stack" should not be taken, however, as necessarily requiring any particular spatial arrangement of the food items. All that is required is that a separator be disposed between the food items. Moreover, although reference is made herein to "a" separator, and usually just one separator is disposed between any two adjacent food items, more than one separator may be disposed between any two adjacent food items if desired. And, in a stack of more than two food items, it will usually be preferred to use two or more separators, typically one separator between two adjacent food items, depending on the total number of food items in the stack.

The shape of the separator is often generally flat, as for example the shape characteristic of a plane. When the size of the separator is described in the sense of a plane, it may be said that the separator is very large in planar area compared to its thickness. The separator will generally have a thickness of at least about 0.06 inches but no more than about 0.25 inches. It is usually preferable for the dimensions of the cross sectional area of the separator to be of sufficient size that the edges of the separator extend and protrude beyond the edges of the food items in the stack since that will maximize the likelihood that vapor will be enabled to move between the food items and ultimately move out and away from the stack of food items.

Describing the separator in planar terms does not, however, mean that it is required to be completely flat, i.e. a geometrically perfect plane, as the separator may when desired have ripples, waves or undulations. These ripples, waves or undulations in the separator would create space between the stacked food items enabling vapor to move between the stacked food items. Channels in the surface of the separator would also be an effective means for enabling vapor to move between stacked food items. Such channels may be on one or both of the top and bottom surfaces of the separator.

A preferred structure for the separator is to enable vapor to move between stacked food item by means of holes, apertures or windows in the separator. When any one of the foregoing is present in the separator, the separator is often essentially planar in form, and is shaped essentially as a flat plate. A hole, perforation, aperture or window in the separator may be any size or shape. Although a hole often denotes a circular opening, the size and shape of openings in the separator through which vapor may pass is essentially unlimited. A channel, hole, perforation, aperture or window may be cut into the separator after manufacturing, or may be formed in the separator at the same time at which it is being manufactured.

When one or more windows are used to enable vapor to move through the separator and thus between stacked food items, the windows are typically defined by mullions. Although a mullion is conventionally thought of as that which secures a window pane in the context of a frame provided by a larger physical structure, the windows in the separator of this invention may be defined by mullions in a frame, or by mullions without a frame. The mullions by which a separator of this invention is constructed may define a straight or curved line in the general plane of the separator. The frame, within which mullions define one or more windows, may also be shaped as a straight or curved line, or as a circle or oval, in the general plane of the separator. A separator that is constructed of mullions within a frame may be hung for storage when not in use.

The operational aspect of those features of this invention may be seen by referring to FIGS. 3, 4, 6, 8, 10, 12–14, 16 and 18–20 in which a window 2 is defined by a mullion 4 in a frame 6. By contrast, in FIGS. 1, 5, 7, 9, 11, 13, 15, 17 and 21, a window 2 is defined by a mullion 4 without a frame. A frame is not necessary if the various mullions are anchored or secured in some manner to a central member or other means of support. This central member or means of support 8 may be seen in FIGS. 1, 5, 7, 9, 11, 13, 15, 17 and 21.

The use of mullions as a means to enable vapor to move between stacked food items provides an opportunity to use the mullions, with or without a frame, in a decorative or functional manner. For example, the mullions may be arranged in design in the plane of the separator to present a geometric pattern, as in FIGS. 1, 3–9, 14 and 15; to portray a known object, as in FIGS. 10–13 and 16–19; or to spell a word, as in FIGS. 20 and 21. The mullions may also be designed to present a commercial logo or trademark.

The separator may be made from paper or plastic or from other materials from which microwave dishes are typically made. Paper or plastic is preferred if the separator is to be used only once before being discarded. This would typically be the case where the consumer buys the separator prepackaged with the food items, i.e. in a pre-formed stack. Plastic materials may be preferred for ease of cleaning when the separator is intended for repeated use. The method of fabricating the separator from paper, plastic or other materials is well known to those skilled in the art.

The food items that are separated by the separator of this invention may be any type of food product, but they are most often a food product made from dough. The dough may be made from a grain, such as corn, wheat or rice. When the food item is made from dough, it may be prepared for example by baking or frying, and is often made by rolling, such as the method typically employed to make a tortilla.

When tortillas are heated in a stack with separators disposed therebetween, the tortillas do not become soggy. After heating, the separators may be left between the tortillas until they are eaten. This prevents the tortillas from becoming stuck together by residual moisture, and creates an air gap between adjacent tortillas, in which heat may be trapped to keep the food warmer longer.

Figure 22:
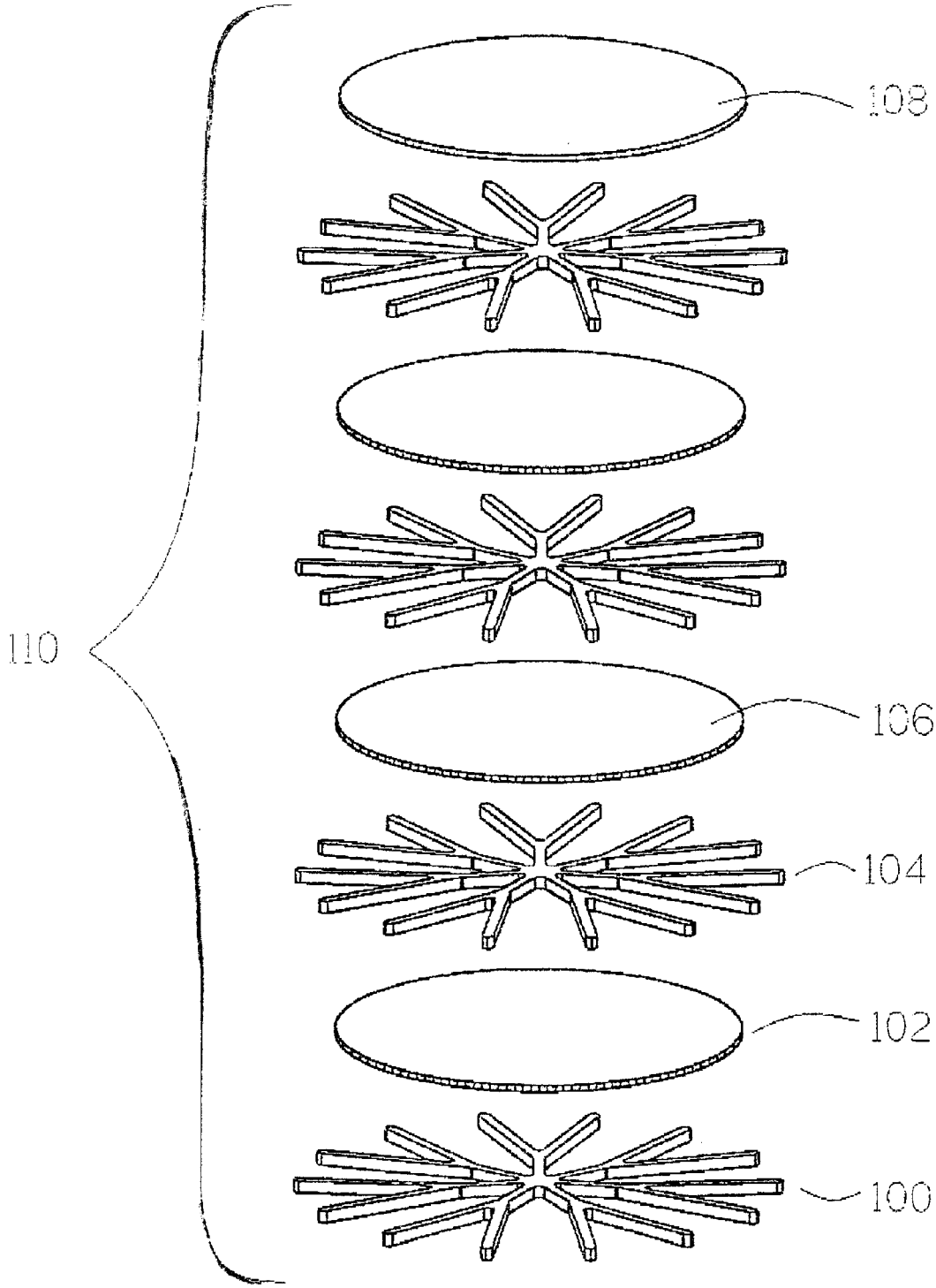
Figure 23:
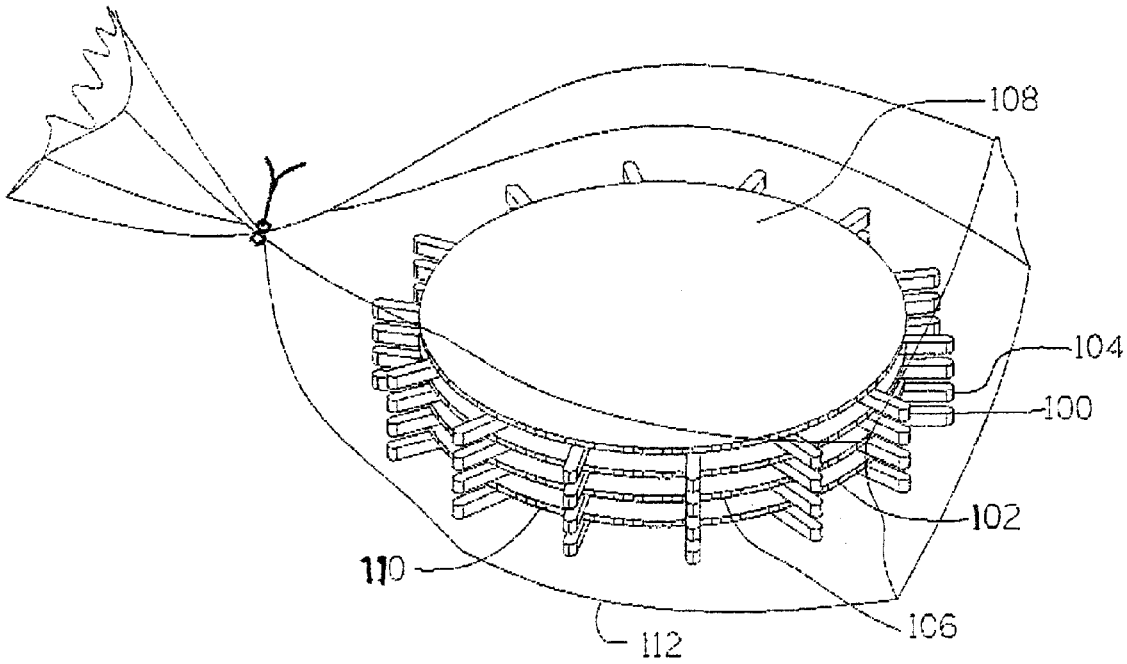
Figure 24:
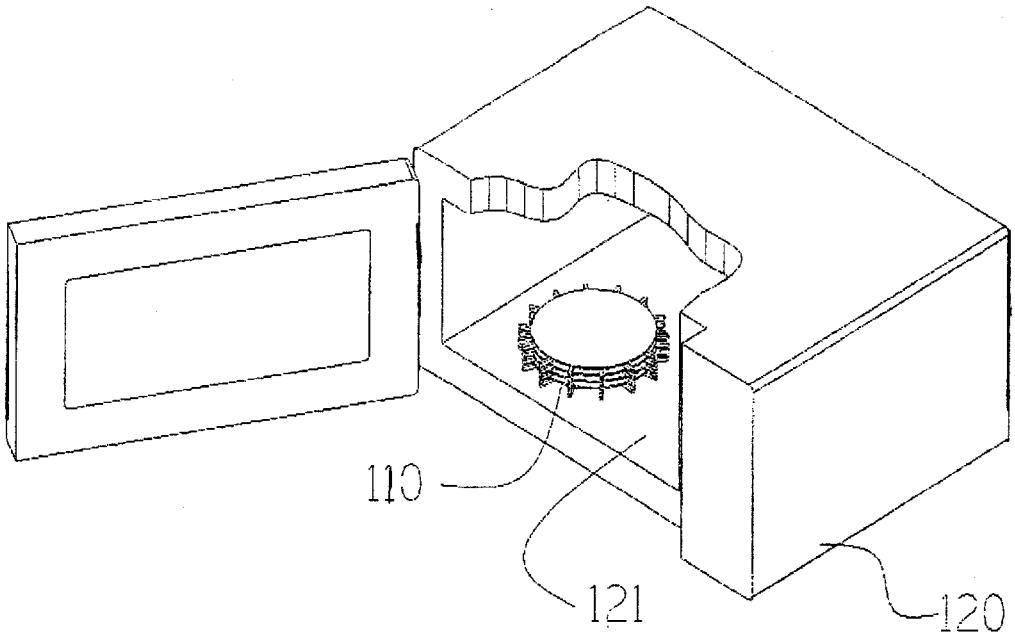

With reference to FIGS. 22–24, the tortilla stack of the present invention generally comprises a plurality of separators and a plurality of pre-cooked tortillas, e.g. soft wheat flour tortillas, alternatingly placed on top of each other in a vertical stack, e.g. a first separator 100, a first tortilla 102 on top of the first separator, a second separator 104 on top of the first tortilla 102, a second tortilla 106 on top of the second separator 104, and so on up to the top tortilla 108. Each tortilla is thus spaced away from each adjacent tortilla or subjacent surface of another food item, respectively. The stack 110 is preferably prepackaged for distribution to the consumer, e.g. in a box, wrapper or bag 112, from which the stack can be removed for re-heating. Alternatively, the stack 110 can be assembled by the microwave oven operator from separately packaged and/or distributed tortillas and separators.

As seen in FIG. 24, the stack 110 thus obtained or assembled can be placed directly in the microwave oven 120, directly on a bottom surface 121 of the heating chamber or on a cooking tray, microwave-safe plate, paper towel or the like placed on the surface 121, and radiated with microwaves for a suitable time period to effect heating of the tortillas. The separators are preferably transparent to the microwaves.

Figure 25:
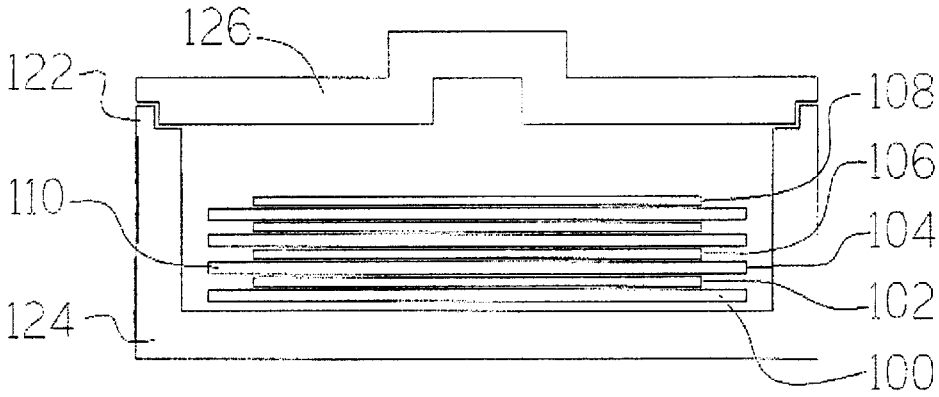

In one preferred embodiment seen in FIG. 25, the stack 110 is placed in a microwave-safe container 122, e.g. a thermally resistant plastic, which has rigid vertical walls 124, e.g. cylindrical walls, having an interior dimension to accommodate the stack 110 of food items and is closed with a removable lid 126. The container 122 preferably has insulating characteristics to aid in keeping the re-heated tortillas hot for a longer period of time when used as a serving container following the heating cycle.

What is claimed is:

1. An assembly of prepared food items and separators alternatingly stacked for microwave re-heating, comprising:

a plurality of prepared food items arranged in a stack;

separators disposed freely between adjacent food items for releasing water vapor;

each separator between adjacent food items comprising an essentially planar structure having a top surface and a bottom surface with mullions, channels, ridges or perforations to enable water vapor to move between and away from the adjacent prepared food items;

each separator between adjacent food items having the bottom surface supported on a superior surface of a first one of the adjacent food items and the upper surface supporting an inferior surface of a second one of the adjacent food items.

2. The assembly of claim 1 further comprising a lowermost separator below a lowermost one of the said plurality of food items.

3. The assembly of claim 1 wherein the food items comprise tortillas.

4. The assembly of claim 3 wherein the tortillas are corn tortillas.

5. The assembly of claim 1 further comprising a packaging for the stack.

6. The assembly of claim 5 wherein the packaging comprises a bag.

7. The assembly of claim 1 further comprising a microwave-safe container housing the stack.

8. The assembly of claim 7 wherein the container comprises thermal insulation.

9. The assembly of claim 8 wherein the container comprises rigid vertical walls and a removable lid.

10. A method for reheating prepared food items, comprising:

placing the assembly of claim 1 in the heating compartment of a microwave oven;

introducing microwaves into the heating compartment to heat the prepared food items;

allowing water vapor to escape via the separators.

11. A method for reheating prepared food items, comprising:

placing the assembly of claim 2 in the heating compartment of a microwave oven with the lowermost separator on a microwave support surface;

introducing microwaves into the heating compartment to heat the prepared food items;

allowing water vapor to escape via the separators.

12. A method for reheating tortillas, comprising:

placing the assembly of claim 3 in the heating compartment of a microwave oven;

introducing microwaves into the heating compartment to heat the tortillas;

allowing water vapor to escape via the separators.

13. A method for reheating corn tortillas, comprising:

placing the assembly of claim 4 in the heating compartment of a microwave oven;

introducing microwaves into the heating compartment to heat the corn tortillas;

allowing water vapor to escape via the separators.

14. A method for reheating prepared food items, comprising:

removing the stack from the packaging of the assembly of claim 5;

placing the stack in the heating compartment of a microwave oven;

introducing microwaves into the heating compartment to heat the prepared food items;

allowing water vapor to escape via the separators.

15. A method for reheating prepared food items, comprising:

removing the stack from the bag of the assembly of claim 6;

placing the stack in the heating compartment of a microwave oven;

introducing microwaves into the heating compartment to heat the prepared food items;

allowing water vapor to escape via the separators.

16. A method for reheating prepared food items, comprising:

placing the assembly of claim 1 in a resealable microwave-safe container;

placing the assembly in the container in the heating compartment of a microwave oven;

introducing microwaves into the heating compartment to heat the prepared food items;

allowing water vapor to escape via the separators.

17. A method for reheating prepared food items, comprising:

placing the assembly of claim 1 in a resealable microwave-safe container comprising thermal insulation;

placing the assembly in the container in the heating compartment of a microwave oven;

introducing microwaves into the heating compartment to heat the prepared food items;

allowing water vapor to escape via the separators;

serving the heated food items in the container.

18. A method for reheating prepared food items, comprising:

placing the assembly of claim 1 in a resealable microwave-safe container comprising thermal insulation, rigid vertical walls and a removable lid;

placing the assembly in the container in the heating compartment of a microwave oven;

introducing microwaves into the heating compartment to heat the prepared food items;

allowing water vapor to escape via the separators;

serving the heated food items in the container;

removing and replacing the lid to access the heated food items.

* * * * *